US010792720B2

(12) United States Patent
Horike et al.

(10) Patent No.: US 10,792,720 B2
(45) Date of Patent: Oct. 6, 2020

(54) HEMMING DEVICE AND HEMMING METHOD

(71) Applicant: HIROTEC CORPORATION, Hiroshima (JP)

(72) Inventors: Kohei Horike, Hiroshima (JP); Makoto Tominaga, Hiroshima (JP)

(73) Assignee: HIROTEC CORPORATION, Hiroshima (JP)

( * ) Notice: Subject to any disclaimer, the term of this patent is extended or adjusted under 35 U.S.C. 154(b) by 203 days.

(21) Appl. No.: 15/745,259

(22) PCT Filed: Jun. 16, 2017

(86) PCT No.: PCT/JP2017/022269
§ 371 (c)(1),
(2) Date: May 18, 2018

(87) PCT Pub. No.: WO2018/229963
PCT Pub. Date: Dec. 20, 2018

(65) Prior Publication Data

US 2018/0361453 A1 Dec. 20, 2018

(51) Int. Cl.
*B21D 39/00* (2006.01)
*B21D 19/04* (2006.01)
(Continued)

(52) U.S. Cl.
CPC ..... *B21D 19/043* (2013.01); *B21D 39/023* (2013.01); *B21D 43/003* (2013.01)

(58) Field of Classification Search
CPC .. B21D 43/003; B21D 39/021; B21D 39/023; B21D 19/043; B21D 37/145;
(Continued)

(56) References Cited

U.S. PATENT DOCUMENTS 5,566,840 A * 10/1996 Waldner ..... G03F 9/00 211/41.17
9,003,646 B2 * 4/2015 Kim ..... B25J 9/0084 269/289 R
(Continued)

FOREIGN PATENT DOCUMENTS

CN 101415521 A 4/2009
CN 103042121 A 4/2013
(Continued)

OTHER PUBLICATIONS

INGEMAT, S.L.-BIW., "INGEMAT, Assembly Lines with roller hemming, hood, tailgate & decklid, Ford Focus Russia (2014)", Jun. 1, 2016, Youtube, https://www.youtube.com/watch?v=0T6TNwAv5ck (Year: 2016).*
(Continued)

*Primary Examiner* — Adam J Eiseman
*Assistant Examiner* — Dylan Schommer
(74) *Attorney, Agent, or Firm* — Robert P. Michal, Esq.; Carter, DeLuca & Farrell LLP

(57) ABSTRACT

A hemming device includes an anvil for placing a work, a presser material handling portion, a conveyance robot, and a roller hemming robot. The anvil includes an anvil main body portion, a positioning device, a gripping device, and a device-side ATC device to be attached to and detached from a conveyance-robot side ATC device. The presser material handling portion includes a frame portion having a shape corresponding to a shape of the work, a positioning device, a gripping device, a presser provided to press the inner panel at a position at which the presser does not interfere with a final shape, and a device-side ATC device to be attached to and detached from the conveyance-robot side ATC device. With this configuration, processing time is reduced and
(Continued)

replacement operation of the anvil is simplified, and therefore productivity is improved.

8 Claims, 11 Drawing Sheets

(51) Int. Cl.
*B21D 43/00* (2006.01)
*B21D 39/02* (2006.01)

(58) Field of Classification Search
CPC ..... B21D 37/147; B21D 19/04; B21D 43/26; B23P 21/00; B62D 65/02; B21J 13/10
USPC ..... 269/317, 319, 903; 901/1, 2, 16, 30
See application file for complete search history.

(56) References Cited

U.S. PATENT DOCUMENTS

| | | | | |
|---|---|---|---|---|
| 9,393,608 | B2 * | 7/2016 | Kraus | B21D 19/043 |
| 9,393,698 | B1 | 7/2016 | Vo | |
| 9,533,341 | B2 * | 1/2017 | Ikeda | B21D 39/021 |
| 9,630,235 | B2 * | 4/2017 | Takai | B21D 19/043 |
| 2009/0089995 | A1 * | 4/2009 | Toeniskoetter | B21D 39/021 29/463 |
| 2010/0252973 | A1 | 10/2010 | Reith et al. | |

FOREIGN PATENT DOCUMENTS

| | | | |
|---|---|---|---|
| CN | 103128186 | B | 12/2016 |
| JP | 2013116501 | A | 6/2013 |
| JP | 2013248620 | A | 12/2013 |
| JP | 201457998 | A | 4/2014 |
| KR | 1020110028128 | A | 3/2011 |
| WO | WO-2010137622 | A1 | 12/2010 |
| WO | 2011135620 | A1 | 11/2011 |
| WO | WO-2016152968 | A1 | 9/2016 |

OTHER PUBLICATIONS

NachiRobotic, "Robots for Handling Heavy Loads", Nov. 2013, NachiRobotic (Year: 2013).*

NachiRobotic, "Servo Press Robot Hemming System (SRA210H/SRA266H)", May 18, 2016, Youtube, https://www.youtube.com/watch?v=8iOoeNe6BT8 (Year: 2016).*

Search Report and Written Opinion issued by the Japanese Patent Office acting as the International Searching Authority in relation to International Patent Application No. PCT/JP2017/022269 dated Sep. 5, 2017 (10pages) along with English language translation of International Search Report (3 pages).

Office Action issued by the China State Intellectural Property Office in relation to Chinese Application No. 201780002217.8 dated Oct. 22, 2019 (7 pages) along with English language translation (6 pages).

Extended European Search Report issued by the European Patent Office in relation to European Application No. 17826123.6 dated Nov. 11, 2019 (8 pages).

* cited by examiner

Prior Art

HEMMING DEVICE AND HEMMING METHOD

CROSS-REFERENCE TO RELATED APPLICATIONS

This application is a national phase entry under 35 U.S.C. 371 of International Patent Application No. PCT/JP2017/022269 filed Jun. 16, 2017, the entire disclosure of which is expressly incorporated herein by reference in its entirety.

TECHNICAL FIELD

The present invention relates to a hemming device used to process works. In particular, the present invention relates to a hemming device including a presser hand that holds a work and is mutually engaged with an anvil and a hemming method.

BACKGROUND ART

Conventionally, a processing device for hemming an outer panel and an inner panel has been used in a manufacturing site of doors for automobiles. As such a device, there is known, for example, a roller-type hemming device for carrying out hemming while pressing a roller serving as processing means to a work (see, for example, Patent Literature 1).

As illustrated in FIG. 11, a hemming device disclosed in Patent Literature 1 includes an anvil 102 for placing a work P, a presser hand 104 for holding the work P, a conveyance robot 105 for conveying this presser hand 104 to bring the work P to the anvil 102 or bring out the work P therefrom, and fastening means 106 for pressing the work P placed on the anvil 102 to the anvil 102 to fasten the work P. This fastening means 106 includes an ATC device 161 for integrally fastening the presser hand 104 and the anvil 102 and a presser pad 162 for pressing the work P to the anvil 102 to fasten the work P.

In a case where processing is carried out by using the above hemming device, first, the conveyance device 105 holds a work P including an outer panel P1 and an inner panel P2 combined with each other with the presser hand 104. Thereafter, the conveyance robot 105 conveys the presser hand 104 holding the work P to the anvil 102. Then, the conveyance robot 105 places the work P on the anvil 102. The work P placed on the anvil 102 is pressed by the conveyance robot 105. Then, the presser hand 104 and the anvil 102 are connected by the ATC device 161. The presser pad 162 abuts on an inside of an outer edge portion of the work P. With this, the work P is fastened to the anvil 102. The work P is subjected to predetermined processing by a roller in a state in which the fastening means 106 fastens the work P to the anvil 102 so that the work P is not shifted. When the processing is terminated, connection of the ATC device 161 is canceled. The conveyance robot 105 holds the presser hand 104 and brings out the work P.

CITATION LIST

Patent Literature

PATENT LITERATURE 1: WO 2016/152968 A

SUMMARY OF THE INVENTION

Problems to be Solved by the Invention

According to the roller hemming device disclosed in Patent Literature 1, the ATC device 161 for integrally fastening the presser hand 104 and the anvil 102 is provided outside the anvil 102. Therefore, at the time of hemming an outer edge portion of a work P, the fastening means 106 supporting the ATC device 161 provided on the periphery of the anvil 102 and a roller 111 interfere with each other. Therefore, it is necessary to process the outer edge portion while avoiding interference with the roller. This complicates a processing path. With this, processing time is increased, which is problematic.

Further, in the hemming device disclosed in Patent Literature 1, the presser hand and the anvil are integrally provided by a connection device at the time of switching a type of vehicle. Thereafter, a robot is connected to the connection device provided on the presser hand. The whole device is moved by the robot. Therefore, it is necessary to provide a robot having a high conveyance capacity. This increases facility costs and, at the same time, increases replacement operation time at the time of switching a type of vehicle and increases an installation place, which are problematic.

The present invention has been made in view of such a background. An object of the present invention is to provide a hemming device capable of reducing processing time, achieving short production cycle time, and reducing a weight of a production facility unique to each model, such as an anvil, to simplify and increase speed of replacement operation, thereby improving productivity.

Solution to the Problems

To achieve the above object, an invention according to claim 1 is a hemming device including: an anvil for placing a work including a first plate member and a second plate member; a presser material handling portion for holding the work; a conveyance robot for gripping and conveying the presser material handling portion to bring the work to the anvil or bring out the work from the anvil, the conveyance robot including a robot-side ATC device; and a roller hemming robot. The robot hems a peripheral portion of the first plate member while pressing a hemming roller of a roller head to a portion to be processed of the work placed on the anvil until the peripheral portion has a final shape in which the peripheral portion and a peripheral portion of the second plate member overlap so that the first plate member and the second plate member are integrated; the anvil includes an anvil main body portion, a positioning device 1 provided at a position corresponding to a position of an opening of the work, a gripping device 1 for sucking and gripping the first plate member, and a device-side ATC device to be attached to and detached from the robot-side ATC device; and the presser material handling portion includes a frame portion having a shape corresponding to a shape of the work, a positioning device 2 arranged at a position corresponding to a position of the positioning device 1 and engaged with the positioning device 1, a gripping device 2 for sucking and gripping the first plate member through an opening of the second plate member, a presser for pressing the second plate member, the presser being provided at a position at which the presser does not interfere with the final shape, and a device-side ATC device to be attached to and detached from the robot-side ATC device.

With this configuration, it is possible to fasten the work to the anvil and carry out hemming, without providing work positioning means and work fastening means so that the work positioning means and the work fastening means cross a processing path of the roller head as in the conventional example. Therefore, no interfering object exists outside the anvil. Thus, even in a case where the roller is caused to approach from the outside of the anvil at the time of processing using the roller hemming robot, it is unnecessary to set a complicated processing path. As a result, it is possible to reduce processing time. Further, fastening means such as an ATC device does not need to be provided outside the anvil. Therefore, it is possible to reduce a weight and size of the anvil with a simple configuration.

Further, the anvil and the presser material handling portion each include the ATC devices to be attached to and detached from the ATC device of the conveyance robot. Therefore, it is possible to separately convey and replace the anvil and the presser material handling portion at the time of switching a type of vehicle. Thus, it is possible to use a small conveyance robot. This makes it possible to save facility costs and an installation space.

An invention according to claim 2 is the hemming device according to claim 1, in which a press by the presser is carried out by using a weight of the presser material handling portion itself or not only a weight of the presser material handling portion itself but also a synergistic action of suction force of the gripping device 1 and the gripping device 2.

With this configuration, the work fastening means and the work positioning means do not need to be provided to cross the processing path of the roller head unlike the conventional example. This is because it is possible to press the work with a weight of the presser itself or not only a weight of the presser itself but also the synergistic action of the suction force of the gripping device 1 and the gripping device 2. Therefore, there is no interference between the roller head and the fastening means or the like. This makes it possible to reduce processing time. Further, it is possible to reduce a weight of the whole processing device and make the whole processing device compact with a simple configuration.

An invention according to claim 3 is the hemming device according to claim 2, further including a roller head including a device-side ATC device detachable from the robot-side ATC device. The conveyance robot is configured to operate also as a roller hemming robot by removing the presser material handling portion and then attaching the roller head.

With this configuration, by replacing the presser material handling portion with the roller head, the conveyance robot can carry out hemming when the conveyance robot conveys nothing. This makes it possible to efficiently operate the conveyance robot to improve productivity.

An invention according to claim 4 is the hemming device according to claim 2 or 3, in which the roller head is a steerable roller head configured to be attached so that a steerable roller pressing axis has an inclination of 30° to 60° relative to an end surface of a wrist of the robot.

With this configuration, first, it is possible to expand a processing range of the roller hemming robot. This makes it possible to reduce the number of robots and reduce mutual interference between robots that currently carry out hemming to further increase a processing speed. Further, an angle of the roller can be freely changed without changing a posture of an arm, and therefore followability to a curved path is remarkably improved. Thus, it is possible to hem a corner portion at a high speed with high quality without using a corner punch.

An invention according to claim 5 is the hemming device according to claim 3, in which: the anvil is configured to be conveyable by a robot having a conveyance capacity of 270 kg or less; and the conveyance robot replaces the anvil by connecting the robot-side ATC device of the conveyance robot to the device-side ATC device of the anvil.

With this configuration, it is unnecessary to install a robot having a high conveyance capacity for conveying the anvil. Therefore, the anvil can be replaced by a robot equivalent to the roller hemming robot at the time of changing a model. This can reduce facility costs and save a space. Further, when this configuration is combined with the configuration according to claim 3, a single robot can carry out both conveyance of a jig and roller hemming. This makes it possible to reduce the number of robots and improve production efficiency.

An invention according to claim 6 is a hemming method for integrally forming a first plate member and a second plate member by bending a peripheral portion of the first plate member having an opening so that the peripheral portion has a final shape in which the peripheral portion and a peripheral portion of the second plate member overlap, the hemming method including: a placement step; an outer-circumference hemming step; an inner-circumference hemming step; and bringing-out step. The placement step includes sucking and gripping the first plate member by using a presser material handling portion through an opening of the second plate member, conveying the presser material handling portion by connecting a robot-side ATC device of the conveyance robot to a device-side ATC device of the presser material handling portion, positioning and placing the presser material handling portion in a posture corresponding to an upper portion of the anvil, and carrying out a press and support by using a presser; the outer-circumference hemming step includes hemming an outer circumference of a work W by using one or two or more roller hemming robots; the inner-circumference hemming step includes evacuating the presser material handling portion once from a position above the work by using the conveyance robot, and hemming an inner circumference of an opening of the work W by using the roller hemming robots; and the bringing-out step includes bringing out the hemmed work by using the conveyance robot.

With this configuration, the presser material handling portion is evacuated once by the conveyance robot from a position above the work after hemming of the outer circumference of the work is terminated. Therefore, the roller and the presser material handling portion do not interfere with each other at the time of hemming the inner circumference of the opening of the work. Thus, it is unnecessary to set a complicated path of the roller hemming robot. This makes it possible to reduce processing time.

Effects of the Invention

According to a hemming device in the present invention, a clamp device and the like are not provided to cross processing path setting. This makes it possible to set a simple processing path and achieve reduction in processing time because of high-speed roller hemming. In addition, reduction in weight of an anvil can reduce a size of a conveyance robot and save production facility costs and an installation space. Further, it is possible to reduce replacement time of the anvil to improve productivity. With this, the hemming device in the present invention can be suitably applied to a production line for producing various works while switching the works.

BRIEF DESCRIPTION OF THE DRAWINGS

FIG. 7 illustrates a state in which a conveyance robot brings a presser material handling portion gripping a work to an anvil or brings out the presser material handling portion therefrom.

FIG. 8 illustrates a state in which a brought work is fixed to an anvil.

FIG. 9 illustrates a state in which a work is hemmed by a roller.

DESCRIPTION OF THE EMBODIMENTS

A hemming device 1 according to an embodiment of the present invention will be described in detail with reference to the drawings. The hemming device 1 is used to manufacture doors of automobiles. A work W to be processed by the hemming device 1 includes an outer panel W1 to be positioned on outside of a vehicle and an inner panel W2 to be positioned on a vehicle interior side. Further, the work includes a main body portion for receiving a window of a door and a sash portion in which an opening for the window of the door is provided.

Figure 1:
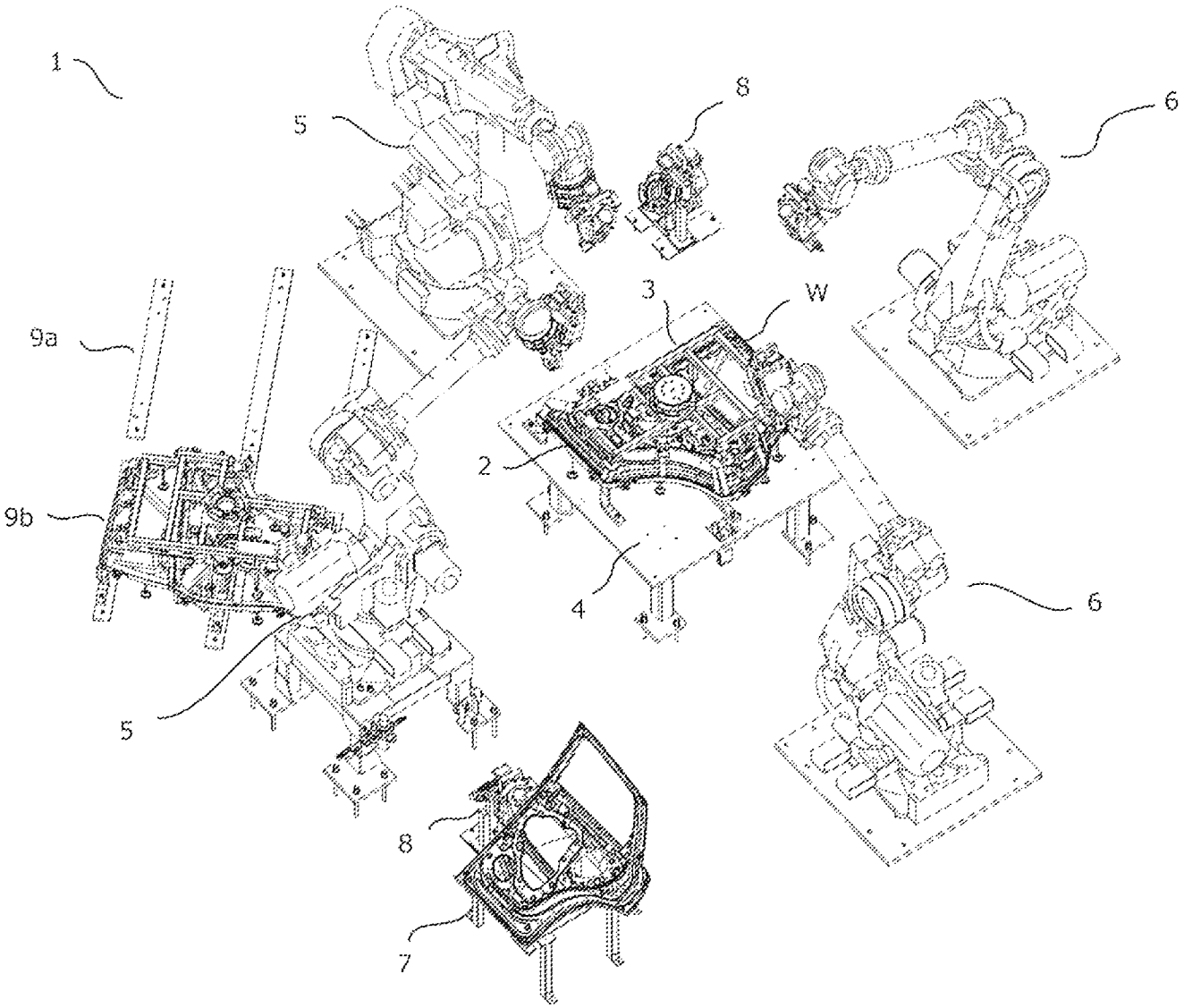
FIG. 1 is a perspective view of the whole configuration of a hemming device according to the present invention.

As illustrated in FIG. 1, the hemming device 1 includes an anvil 2 for placing the work W including the outer panel W1 and the inner panel W2, a presser material handling portion 3 for holding the work W, conveyance robots 5 (two in this example) for gripping and conveying the presser material handling portion 3 to bring the work W to the anvil 2 or bring out the work W therefrom, and roller hemming robots 6 (two in this example). The hemming device hems a portion to be processed of the work W placed on the anvil 2 while pressing a roller to the portion, thereby integrating the outer panel W1 and the inner panel W2. External shapes of the anvil 2 and the presser material handling portion 3 are determined in accordance with a shape of the work W.

A processing process carried out by the hemming device 1 includes a preliminary bending process and a permanent bending process. In the preliminary bending process, a flange portion of the outer panel W1, which has been subjected to flange processing in advance, is bent at a predetermined angle in a state in which a peripheral portion of the inner panel W2 and a portion near a peripheral portion of the outer panel W1 overlap in a plate thickness direction. In the permanent bending process, an outer edge portion of the outer panel W1, which has been preliminary bent, is pressed to the inner panel W2. Then, the outer edge portion is further bent to wrap the inner panel W2 until the outer edge portion and the peripheral portion of the inner panel W2 overlap.

(Anvil)

Figure 2:
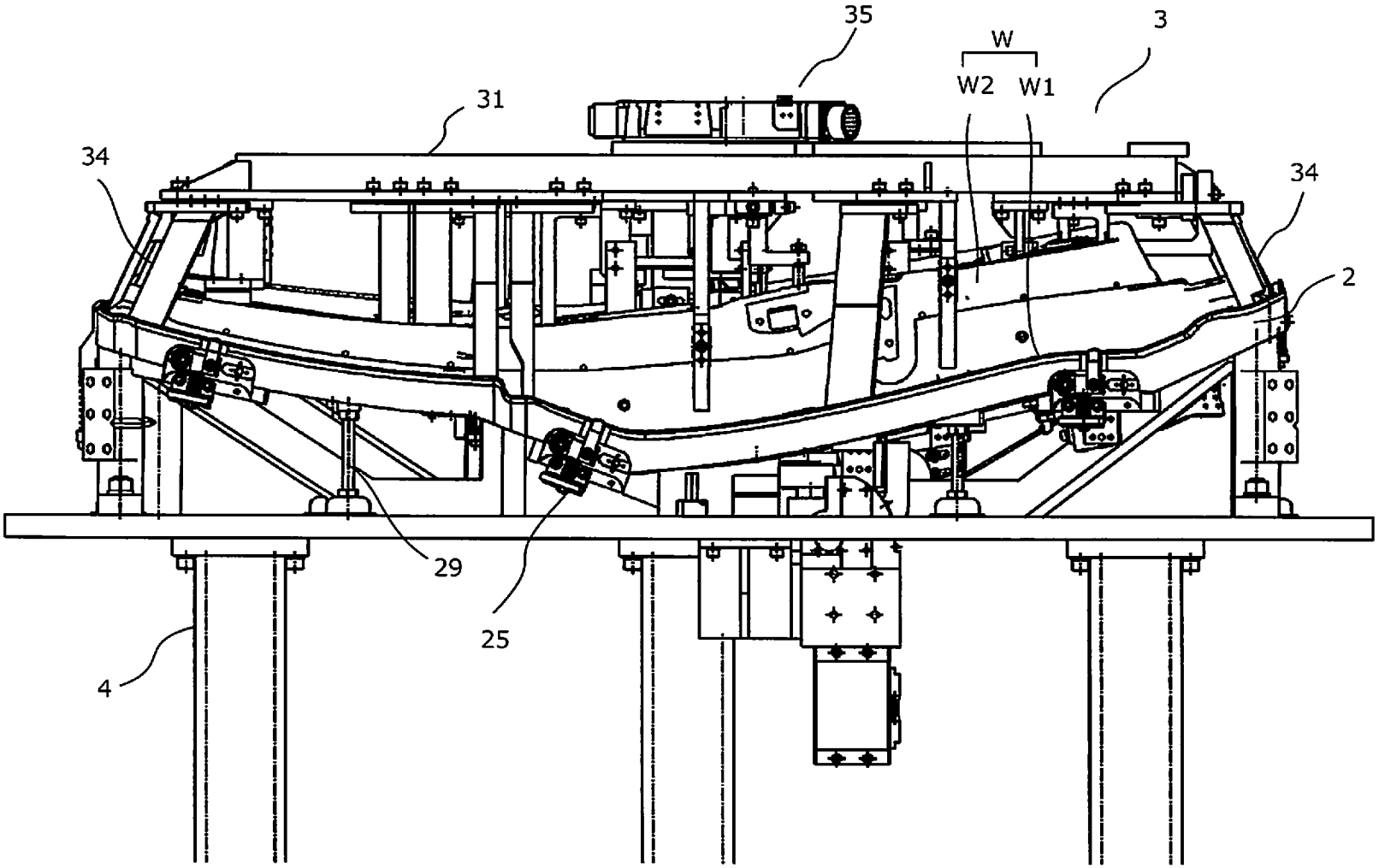
FIG. 2 is a main-part side view of configurations of an anvil and a presser material handling portion according to the present invention.
Figure 3:
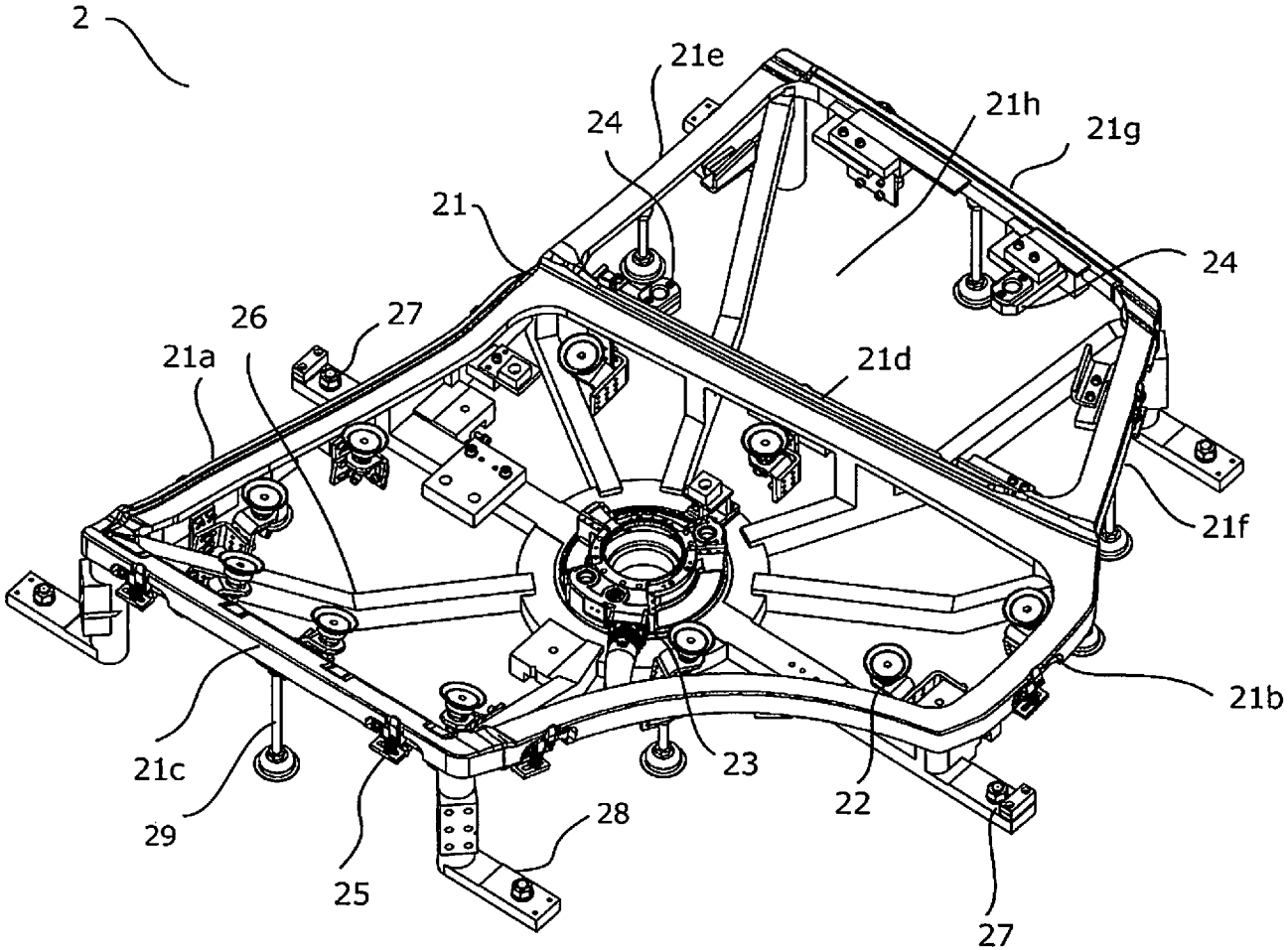
FIG. 3 is a perspective view of a configuration of an anvil according to the present invention.

As illustrated in FIG. 2, the anvil 2 is placed on anvil supports 4 for supporting the anvil 2. As illustrated in FIG. 3, the anvil 2 includes an anvil main body portion 21 for supporting the work W, support brackets 28 arranged at corners of the anvil main body portion 21 to support and fix the anvil main body portion 21, auxiliary supports 29 arranged in the middle of the anvil 2 so as to be capable of adjusting a height thereof to support the anvil 2, a gripping device 22 for sucking and gripping the outer panel W1, an ATC device 23 to be attached to and detached from an ATC device 51 of the conveyance robot 5, two positioning devices 24 to be mutually engaged with positioning devices 36 of the presser material handling portion 3 to carry out relative positioning, and a guide device 25 for fastening an outer edge portion of the flanged work W to carry out positioning.

The anvil main body portion 21 is a portion for supporting the placed work W. The anvil main body portion 21 has a shape accurately corresponding to the shape of the work W so as to support a portion to be hemmed of the work W from a back side. In addition, the anvil main body portion 21 includes a front portion 21*a*, a back portion 21*b*, a lower portion 21*c*, and an upper portion 21*d* that support a main body portion of the outer panel W1 and a front portion 21*e*, a back portion 21*f*, and an upper portion 21*g* that support the sash portion. The anvil main body portion 21 further has an opening 21*h* having a shape corresponding to a shape of the sash portion. Further, the main body portion of the anvil 2 includes a plurality of frames 26 that secure rigidity to reinforce the anvil main body portion 21. In this example, a hub-shaped frame is provided in the center of a lower portion of the anvil main body portion 21 as illustrated in FIG. 3. A plurality of spoke-shaped frames is provided to connect the hub-shaped frame and the anvil to secure a necessary strength.

In production of the anvil main body portion 21, a necessary strength is secured by carrying out sufficient strength analysis using a structure analysis program in advance. In addition, the anvil main body portion 21 is designed to have a minimum weight. In particular, a weight of an anvil portion to which a weight is directly applied at the time of hemming tends to be increased. Therefore, sizes and weights of various members, such as a width of the anvil, are reduced as much as possible. Further, unnecessary devices such as many corner punches used in a conventional roller hemming device are not employed. This further reduces the weight. As a result, the anvil main body portion 21 (rear door for passenger vehicle) in this example achieves 140 kg. With this, the anvil main body portion 21 is conveyed by a robot having a conveyance capacity of 270 kg or less even in a state in which another component or the work W is attached thereto.

The support brackets 28 are arranged at positions in which a weight is concentrated including four corners of the anvil 2. The support brackets 28 support the anvil in a vertical direction and have a function of positioning the anvil in a horizontal direction. Anvil-side reference pins 27 for positioning are provided on at least two bearing surfaces of the support brackets 28, respectively. By inserting the anvil-side reference pins 27 into reference holes (not illustrated) of the anvil supports 4, positioning is carried out in the horizontal direction.

As illustrated in FIG. 2, the auxiliary supports 29 are provided to support the anvil main body portion 21 in the middle of the support brackets 28. Each auxiliary support 29 has a column portion having a male screw portion and a stand-like portion having a corresponding female screw portion. The auxiliary support 29 adjusts a height thereof by adjusting a projected length of the male screw portion. The number of the auxiliary supports 29 and arrangement thereof are determined by strength analysis. In this way, the anvil is supported at an optimal position. This makes it possible to achieve further thinning and reduction in weight of an anvil structure.

The gripping device 22 is a device for sucking and gripping the outer panel W1 included in the placed work W. The gripping device 22 is not particularly limited. It is possible to employ a vacuum cup for sucking and gripping the outer panel W1 by using negative pressure. A predetermined number of gripping devices 22 are provided inside the front portion 21*a*, the back portion 21*b*, the lower portion 21*c*, and the upper portion 21*d* of the anvil main body portion 21. Negative pressure piping (not illustrated) is connected to the gripping devices 22 via a valve gear (not illustrated). The negative pressure piping is connected from the conveyance robot 5 side via a connection portion of the ATC device. By opening and closing operation of the valve gear, the gripping devices 22 can be switched between a state in which negative pressure is applied to portions in contact with the work W and a state in which negative pressure is not applied thereto. When negative pressure is applied to the contact portions between the gripping devices 22 and the work W, the gripping devices 22 suck and hold the work W from below. Meanwhile, when negative pressure is not applied to the contact portions between the gripping devices 22 and the work W, it is possible to remove the work W from the gripping devices 22. Appropriate arrangement of the gripping devices 22 is determined by calculation so as to apply sufficient and uniform gripping force to the work W. Note that this example employs a configuration in which the outer panel W1 is sucked and gripped by using negative pressure. However, it is also possible to employ another configuration using magnetic force or the like.

The ATC device 23 is a well-known automatic tool changer. This ATC device 23 is a device to be attached to and detached from the ATC device 51 of the conveyance robot 5. The ATC device 23 is provided on the top (upper surface) of the hub-shaped frame portion so as not to interfere with the work W. In specific operation, an engagement protruding portion provided in the ATC device 51 of the conveyance robot 5 is positioned and engaged with an engagement recessed portion provided in the ATC device 23 of the facing anvil 2 in a state in which the work W is not placed. This makes it possible to connect the conveyance robot 5 and the anvil 2. The ATC device 23 of the anvil 2 and the ATC device 51 of the conveyance robot 5 are automatically switched by an actuator (not illustrated) between an attached state and a removed state.

The positioning devices 24 are devices to be mutually engaged with the positioning devices 36 provided at positions of the presser material handling portion 3 corresponding to the positioning devices 24 to thereby carry out positioning. The positioning devices 24 are provided in the opening of the anvil main body portion 21 corresponding to the sash portion of the work W. In this example, the positioning devices 24 of the anvil 2 each have positioning holes. The positioning devices 36 of the presser material handling portion 3 each include positioning pins. With this structure, the positioning devices do not need to be arranged at positions at which the positioning devices cross a hemming path. Therefore, the processing path is easily set. Further, high-speed hemming can be carried out.

In order to position and engage the anvil 2 and the presser material handling portion 3, first, the conveyance robot 5 moves the positioning devices 36 of the presser material handling portion 3 to positions above the positioning devices 24 of the facing anvil 2. Then, the conveyance robot 5 moves the presser material handling portion 3 downward. In this way, the positioning pins are inserted into the positioning holes, and therefore both the anvil 2 and the presser material handling portion 3 are engaged. With this, it is possible to position the anvil 2 and the presser material handling portion 3. Tips of the pins are processed to have a tapered shape. Therefore, the positioning holes and the positioning pins can be smoothly engaged while absorbing errors of positions.

Figure 6:
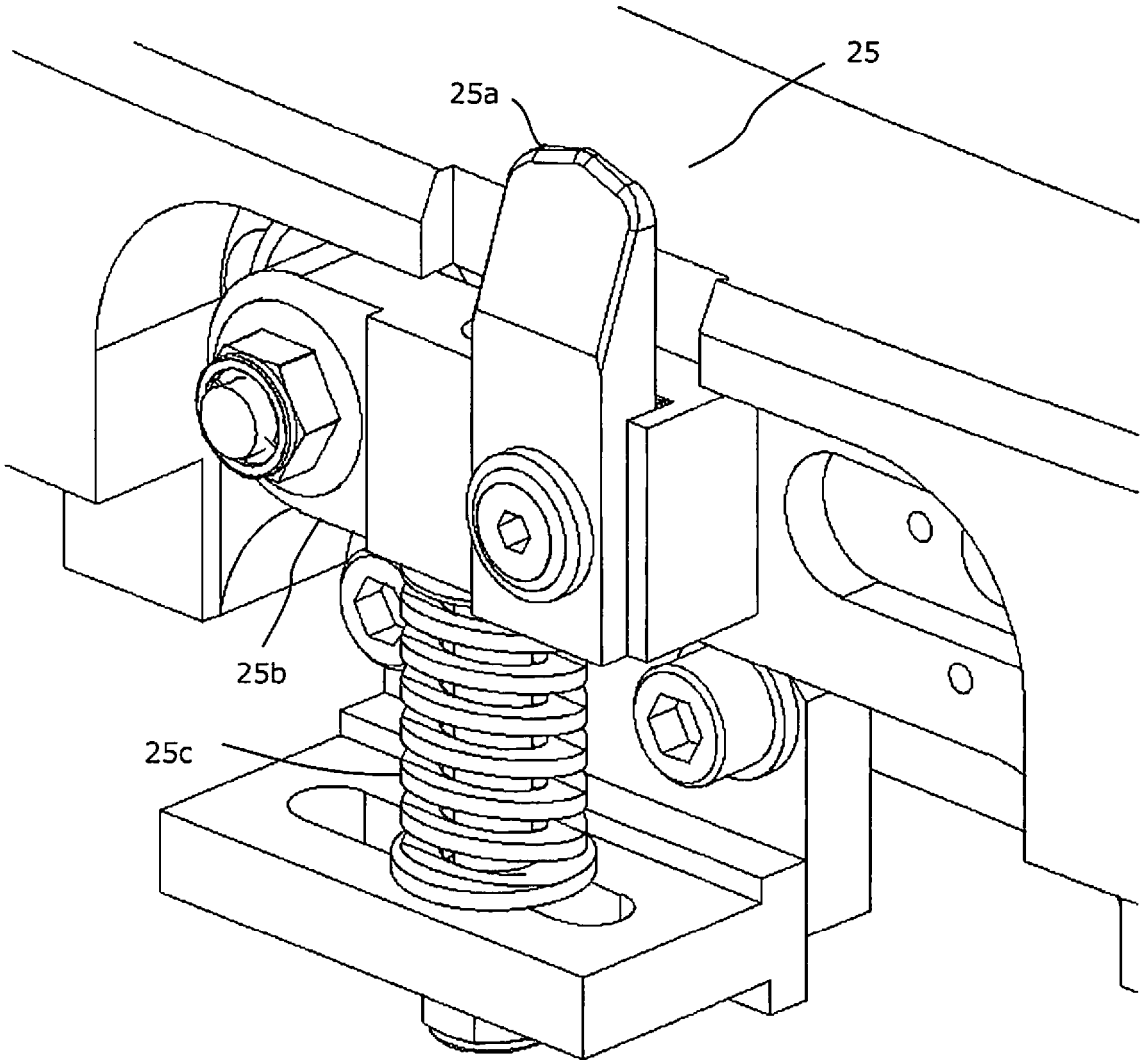
FIG. 6 is a perspective view of a configuration of a guide device according to the present invention.

The guide device 25 fastens the outer edge portion of the outer panel W1 having the flange portion formed in advance. With this, the guide device 25 restricts a position of the work W relative to the anvil 2 and carries out positioning. As illustrated in FIG. 6, the guide device 25 includes a main body portion and a biasing portion 25*c*. An outer guide portion 25*a* to abut on the outer edge portion of the work W to fasten the work W is provided in one end portion of the main body portion. Further, a support portion 25*b* rotatably supported by the anvil 2 is provided in the other end portion of the main body portion. The biasing portion 25*c* biases the main body portion so that an upper end portion of the outer guide portion 25*a* projects from an outer edge of the anvil 2. As illustrated in FIG. 3, a plurality of guide devices 25 is sufficiently provided to hem the work W along an outer edge of the anvil 2 while restricting the position of the work W. The main body portion of the guide device is embedded in the outer edge of the anvil 2. Therefore, the main body portion of the guide device does not interfere with a roller 62 even in a case where the roller 62 approaches from the outside of the anvil 2 at the time of hemming. This makes it possible to carry out positioning so that the position of the work W is securely restricted.

Further, when pressing force is applied by the roller 62, the biasing portion 25*c* of the guide device carries out sinking operation so as to prevent processing from being interrupted at the time of hemming the work W because of interference between the biasing portion 25*c* and the roller 62. Specifically, the roller 62 abuts on an end portion of the outer guide portion 25*a* to apply pressing force. Then, the outer guide portion 25*a* rotatably supported by the support portion 25*b* carries out sinking operation around the support portion 25*b* against biasing force of the biasing portion 25*c*. When the roller 62 passes a position above the outer guide portion 25*a*, the pressing force is no longer applied. Then, the outer guide portion 25*a* returns to an initial position because of the biasing force of the biasing portion 25*c*. That is, the outer guide portion 25*a* returns to a state of positioning the work W.

(Anvil Support)

The anvil supports 4 are base members of the anvil 2. The anvil supports 4 are used by being fixed to a floor surface. Therefore, the anvil supports 4 are strongly produced. The anvil supports 4 reinforce the anvil 2 to restrain deformation and deflection and improve rigidity. In addition, the anvil supports 4 have a function of positioning the anvil 2 while adjusting a height thereof. By using such general and fixed anvil supports 4, the anvil 2 can be made compact and be reduced in weight. In addition, the anvil supports 4 are configured so that the robot can replace the anvil 2 at the time of changing a model. As means for positioning the anvil 2 and the anvil supports 4, two or more bearing surfaces of the support brackets 28 of the anvil 2 include the anvil-side reference pins 27. Further, the anvil supports 4 have the reference holes (not illustrated). The anvil-side reference pins 27 are engaged with the reference holes, and therefore the anvil 2 is positioned with respect to the anvil supports 4. A predetermined number of reference holes are provided at positions of the anvil supports 4 corresponding to positions of the anvil-side reference pins 27 in consideration of a shape, rigidity, and the like of the anvil 2. As described above, with a configuration in which the anvil supports 4 serving as fixed portions are separated from the anvil 2 serving as a portion to be changed for each model and an effect of designing the above anvil 2 so that a weight and size of the anvil 2 are reduced as much as possible, the anvil 2 can be conveyed by the conveyance robot 5 having a conveyance capacity of 270 kg or less.

(Presser Material Handling Portion)

Figure 4:
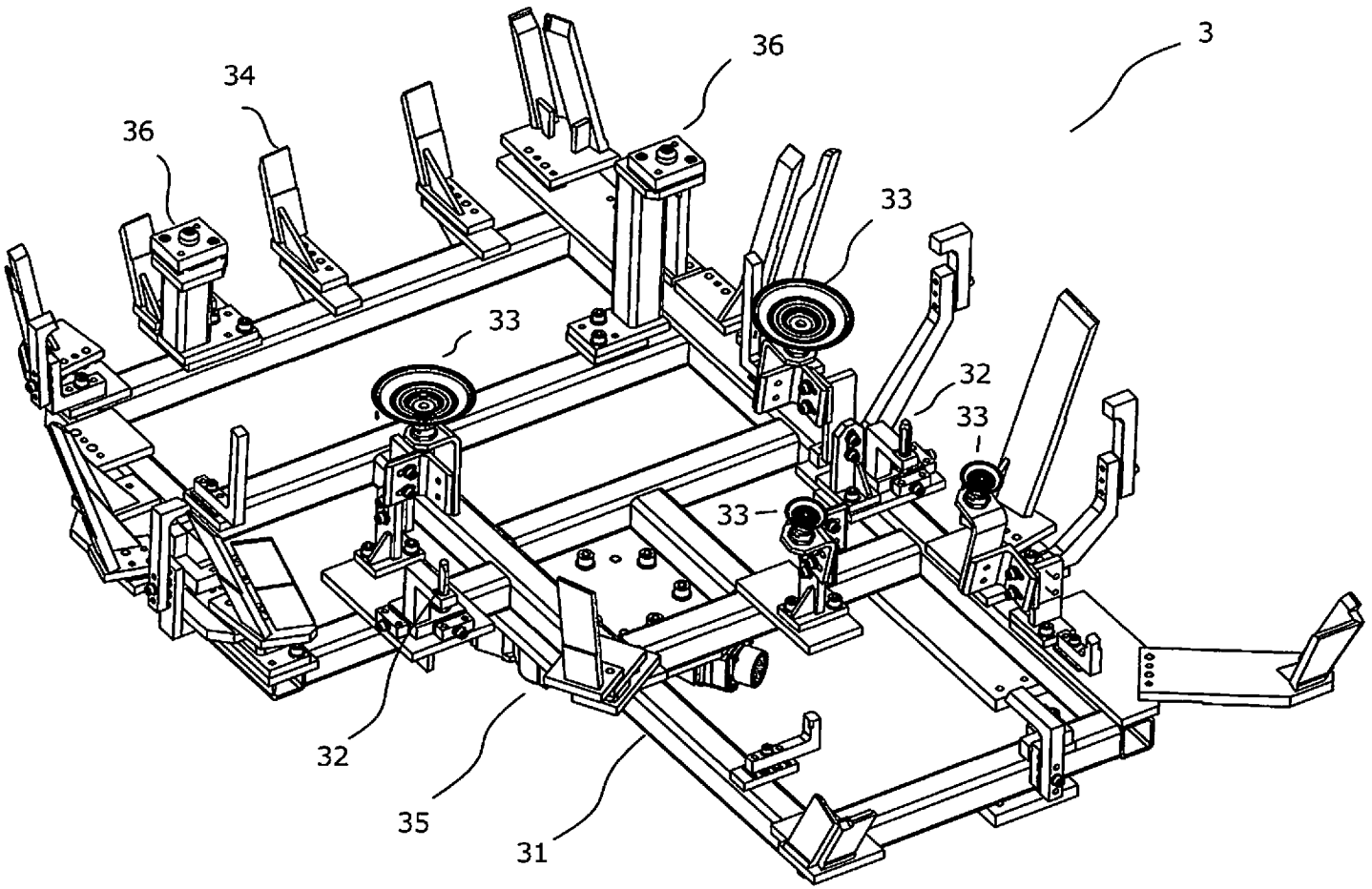
FIG. 4 is a perspective view of a configuration of a presser material handling portion according to the present invention, which is seen in a direction from a lower surface.

As illustrated in FIG. 4, the presser material handling portion 3 includes a frame portion 31 having a shape corresponding to the shape of the work W, two reference pins 32, gripping devices 33, pressers 34, an ATC device 35, and the positioning devices 36. The two reference pins 32 and positioning holes (not illustrated) of the inner panel W2 are engaged, and therefore the inner panel W2 is positioned. The gripping devices 33 suck and grip the outer panel W1 through an opening of the inner panel W2. The pressers 34 are provided to press the inner panel W2 at positions at which the pressers 34 do not interfere with a final shape of the outer panel W1. The ATC device 35 is attached to and detached from the ATC device 51 of the conveyance robot 5. The positioning devices 36 and the positioning devices 24 of the anvil 2 are engaged, and therefore positioning is carried out.

The frame portion 31 has a function of arranging the gripping devices 33 at appropriate positions so that the conveyance robot 5 can convey the work W in a state in which the gripping devices 33 suck and grip the work W. Further, the frame portion 31 also has a function of positioning the anvil 2 via the positioning devices 36, thereby causing the pressers 34 to press the work W to fix the work W to the anvil.

The reference pins 32 are provided at two positions on a lower portion (lower surface) of the frame portion 31 so as to correspond to the positioning holes of the inner panel W2. Then, the reference pins 32 and the positioning holes are engaged, and therefore positioning in which the presser material handling portion 3 holds the work W is carried out.

The gripping devices 33 are provided at four position on the lower portion (lower surface) of the frame portion 31. The gripping devices 33 directly suck and grip the outer panel W1 through the opening of the inner panel W2. This example employs a vacuum cup for sucking and gripping the outer panel W1 by using negative pressure. However, it is also possible to employ another configuration using magnetic force or the like. Configurations of the gripping devices 33 are similar to the gripping devices 22 of the anvil 2. Therefore, description thereof is omitted.

As illustrated in FIG. 4, the pressers 34 are provided on the lower portion (lower surface) of the frame portion 31. The pressers 34 are made up of an L-shaped or I-shaped bar-like member. An appropriate number of pressers 34 are provided at predetermined intervals so as to press the inner panel W2 at positions at which tip portions thereof do not interfere with the final shape of the hemmed outer panel W1. Pressing force is basically generated by a weight of the presser 34 itself. The outer panel W1 and the inner panel W2 are pressed so as not to be shifted from each other in a state in which the work W is placed on the anvil 2. In a case where pressing force is not sufficient or pressing force varies depending on positions, the pressing force is adjusted by arranging weights on the frame portion 31.

With this configuration, it is possible to avoid interference between the roller 62 and the pressers 34 at the time of hemming. Therefore, it is possible to carry out hemming while moving the roller 62 in a state in which the work W is securely gripped by the pressers 34.

The ATC device 35 is provided on an upper portion (upper surface) of the frame portion 31. A configuration of the ATC device 35 is similar to the ATC device 23 of the anvil 2. Therefore, description thereof is omitted.

The positioning devices 36 are provided at positions corresponding to the positions of the positioning devices 24 of the anvil 2. The positioning devices 36 and the positioning devices 24 of the anvil 2 are mutually engaged, and therefore relative positioning is carried out. The configurations of the positioning devices 36 have already been described in the description of the positioning devices 24 of the anvil 2. Therefore, detailed description thereof is omitted.

(Conveyance Robot)

Figure 7:
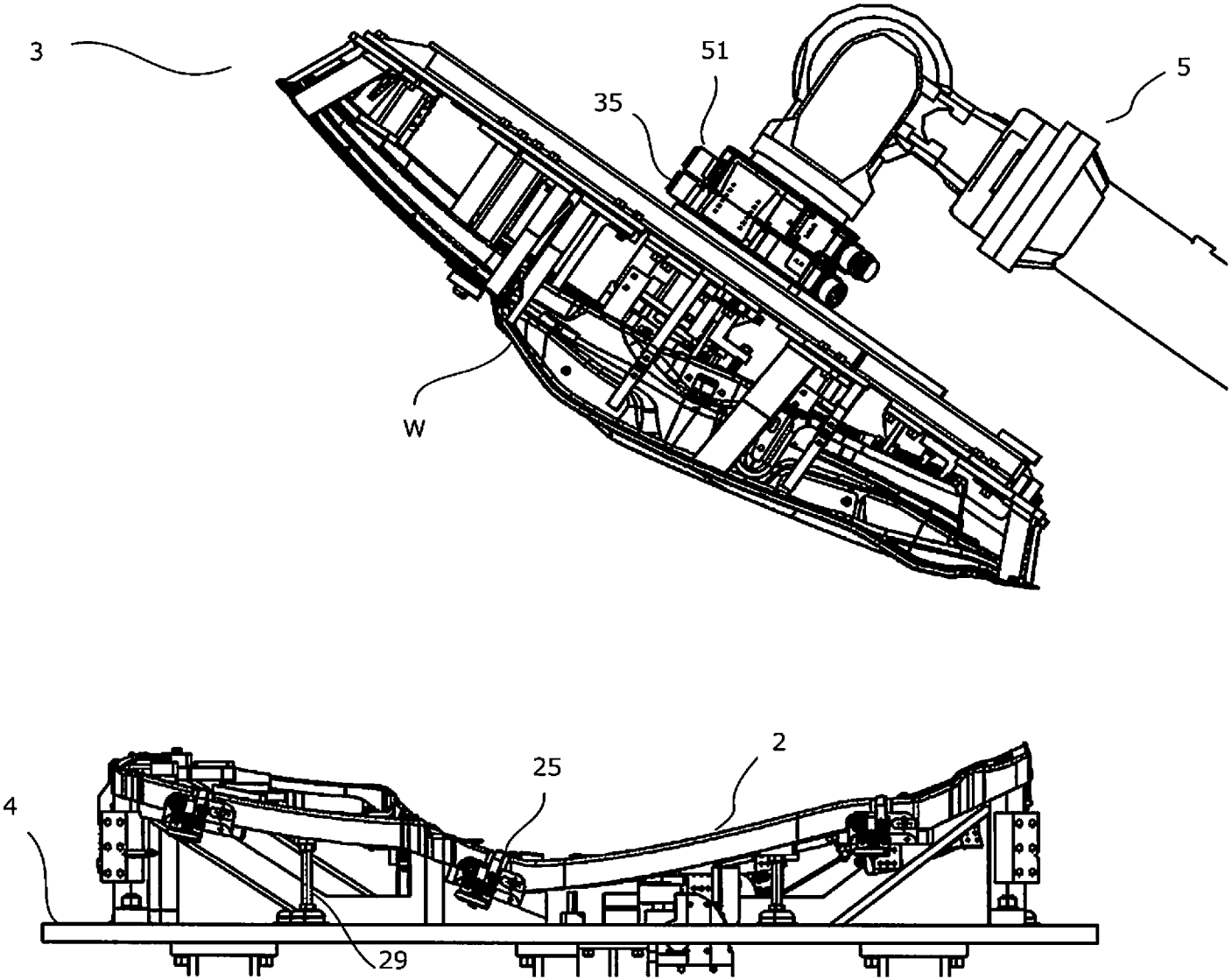
FIG. 7 is a main-part side view corresponding to FIG. 2 and illustrates operation of a hemming device according to the present invention.

The conveyance robot 5 is an articulated robot. The ATC device 51 is provided at a tip portion of a robot arm so as to grip and convey the presser material handling portion 3 to bring the work W to the anvil 2 or bring out the work W therefrom. As illustrated in FIG. 7, it is possible to bring or bring out the work W by connecting the ATC device 51 of the conveyance robot 5 to the ATC device 35 of the presser material handling portion 3. Further, it is possible to replace the anvil by connecting the ATC device 51 of the conveyance robot 5 to the ATC device 23 of the anvil 2.

(Roller Hemming Robot)

The roller hemming robot 6 is an articulated robot including a roller head 61 attached to a tip portion of a robot arm. The roller hemming robot 6 presses the roller 62 of the roller head 61 to a portion to be hemmed of the work W placed on the anvil 2. Simultaneously, the roller hemming robot 6 hems the peripheral portion of the outer panel W1 so that the peripheral portion thereof has a final shape in which the peripheral portion and the peripheral portion of the inner panel W2 overlap.

Figure 5:
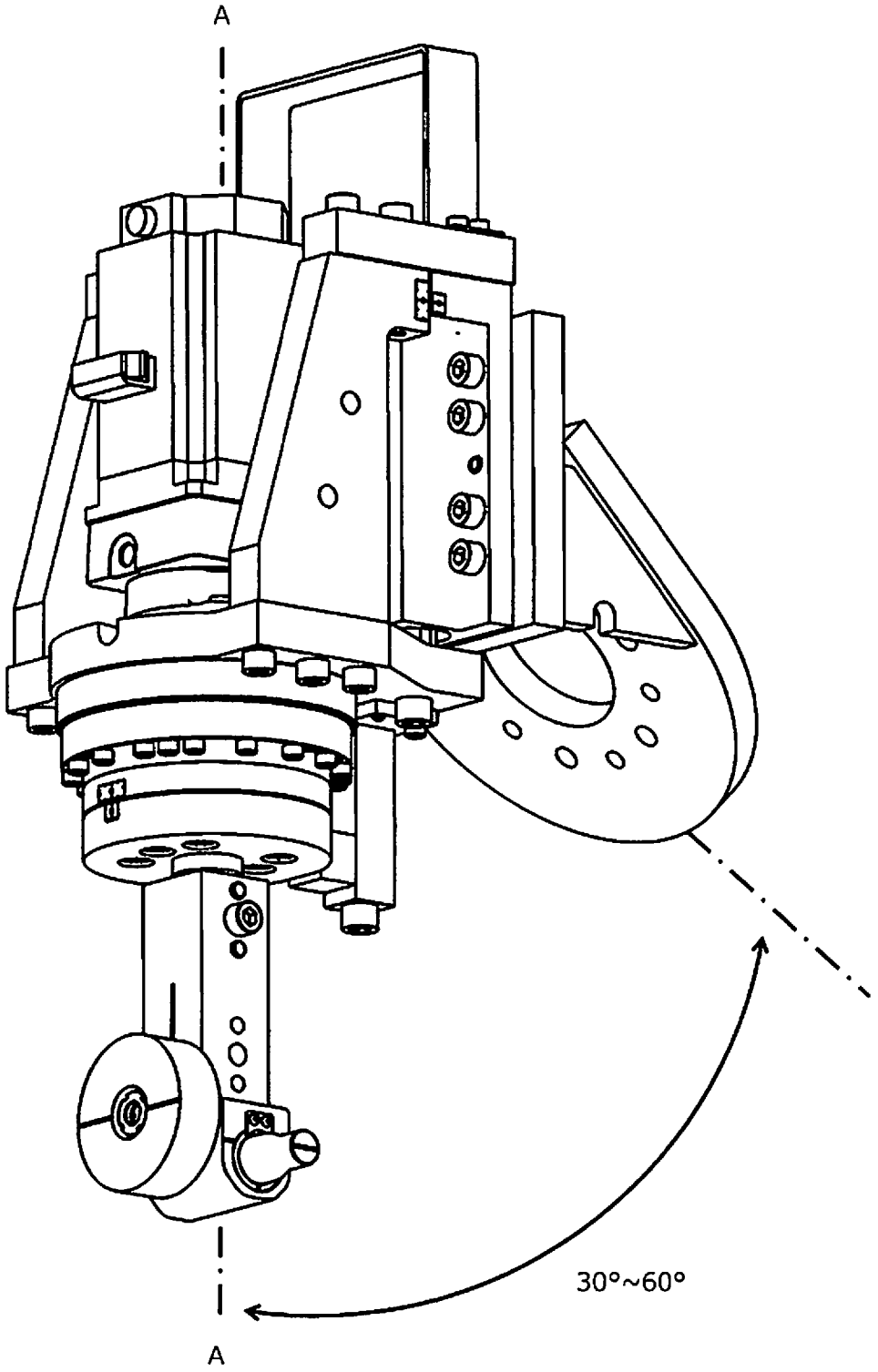
FIG. 5 is a perspective view of a configuration of a roller head according to the present invention.

As illustrated in FIG. 5, the roller head 61 in this example is a steerable roller head 61 that is attached so that a pressing axis A-A of the roller 62 has an inclination of 30° to 60° relative to a portion joined to the tip portion of the robot and the pressing axis A-A of the roller 62 is steerable. With this, it is possible to expand a processable range of the roller 62. This makes it possible to reduce mutual interference between robots that currently carry out hemming. Further, it is possible to change an angle of the roller 62 without largely operating the arm at corner portions of the work W. This remarkably improves a processing speed. Therefore, it is possible to reduce processing time also at the corner portions without providing corner punches in particular. In this example, the processing speed at the corner portions achieves four or more times as high as a processing speed of a conventional roller head. Further, with this, costs of tools that have been conventionally necessary, such as corner punches, are unnecessary.

The ATC device 51 is attached to the conveyance robot 5. Therefore, when connection with the presser material handling portion 3 is canceled and the roller head 61 is attached, the conveyance robot 5 can also operate as a roller hemming robot. With this configuration, the conveyance robot 5 connects the ATC device 51 to the presser material handling portion 3 when, for example, the conveyance robot 5 brings the work W to the anvil 2 or brings out the work W therefrom. At the time of hemming the work W, it is possible to cancel connection between the ATC device 51 and the presser material handling portion 3 and attach the roller head 61. Therefore, it is possible to efficiently operate the robot to improve productivity. In this example, the two conveyance robots 5 and the two dedicated roller hemming robots form the hemming device 1. The ATC device 51 is attached to the conveyance robot 5. With this, it is possible to select one of the presser material handling portion 3 and the roller head 61 and attach the selected member to the conveyance robot 5. Further, the roller head 61 is directly attached to the tip portion of the roller hemming robot. It is possible to adjust the number of those robots in response to, for example, a demand such as a shape of the work W or processing time.

Figure 8:
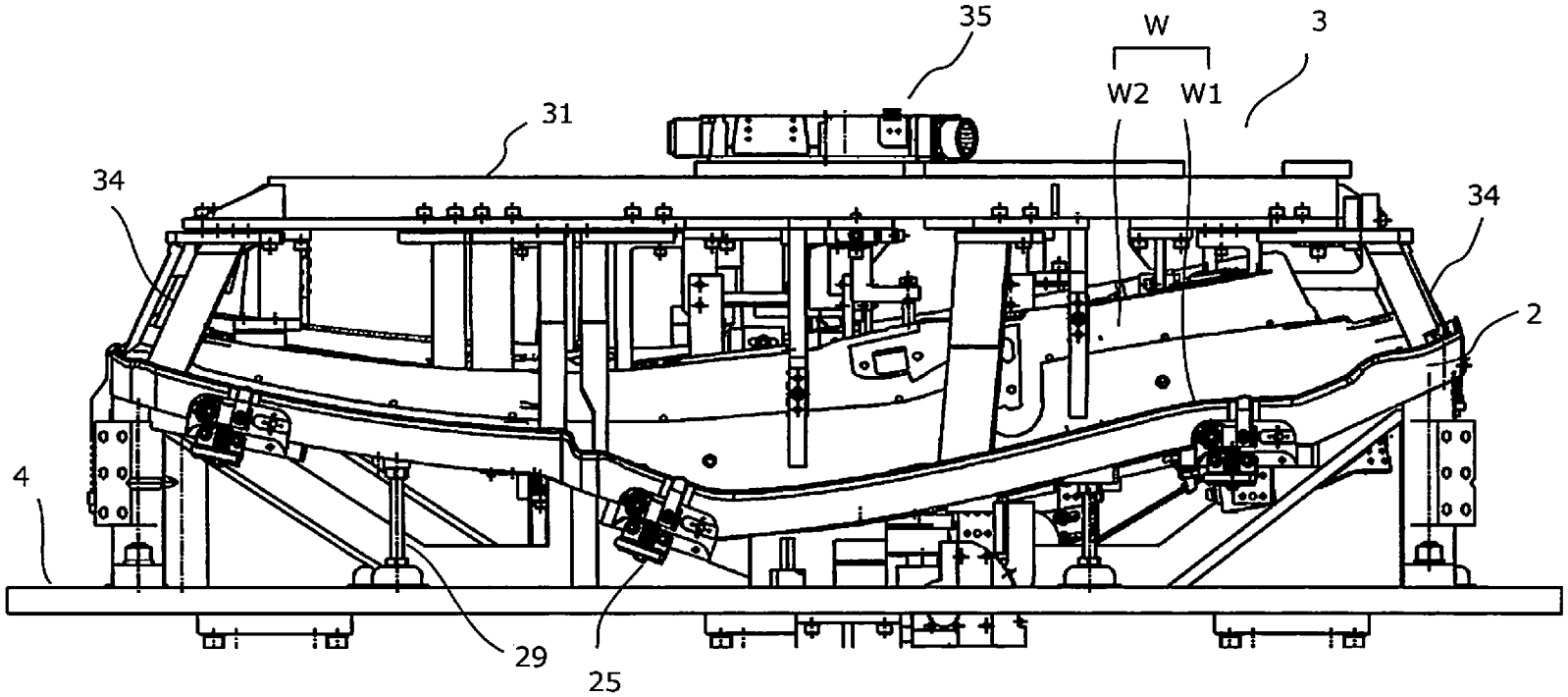
FIG. 8 is a main-part side view corresponding to FIG. 2 and illustrates operation of a hemming device according to the present invention.

Operation using the hemming device 1 configured as described above will be described. The conveyance robot 5 causes the ATC device 51 to grip the presser material handling portion 3. Then, a work W placed on a work placement stand 7 is sucked and gripped by the gripping device 33 of the presser material handling portion 3 through an opening of an inner panel W2. This work W includes an outer panel W1 that has been flanged in advance and the inner panel W2 placed on the outer panel W1. As illustrated in FIG. 7, the conveyance robot 5 moves the presser material handling portion 3 holding the work W to a position above the anvil 2. Then, the conveyance robot 5 engages and positions the positioning devices 36 of the presser material handling portion 3 and the positioning devices 24 of the anvil 2. In this way, the conveyance robot 5 places the work W on the anvil 2 and, as illustrated in FIG. 8, causes the pressers to press and support the work W.

When the conveyance robot 5 completes bringing the work W to the anvil 2, the conveyance robot 5 cancels connection with the presser material handling portion 3. In this example, when connection between the conveyance robot 5 and the presser material handling portion 3 is canceled, negative pressure piping is blocked. Therefore, suction and a grip by the gripping device 33 of the presser material handling portion 3 are canceled. The work W placed on the anvil 2 is fixed to the anvil 2 with the weight of the presser 34 itself and suction force of the gripping devices 22 of the anvil as described above. Note that, in a case where pressing force of the presser material handling portion 3 is insufficient, the work W may be pressed by a synergistic action of suction force of the gripping devices 33 that suck and grip the work W by a method of, for example, continuing connection between the conveyance robot 5 and the presser material handling portion 3 and suction force of the gripping devices 22 of the anvil.

Figure 9:
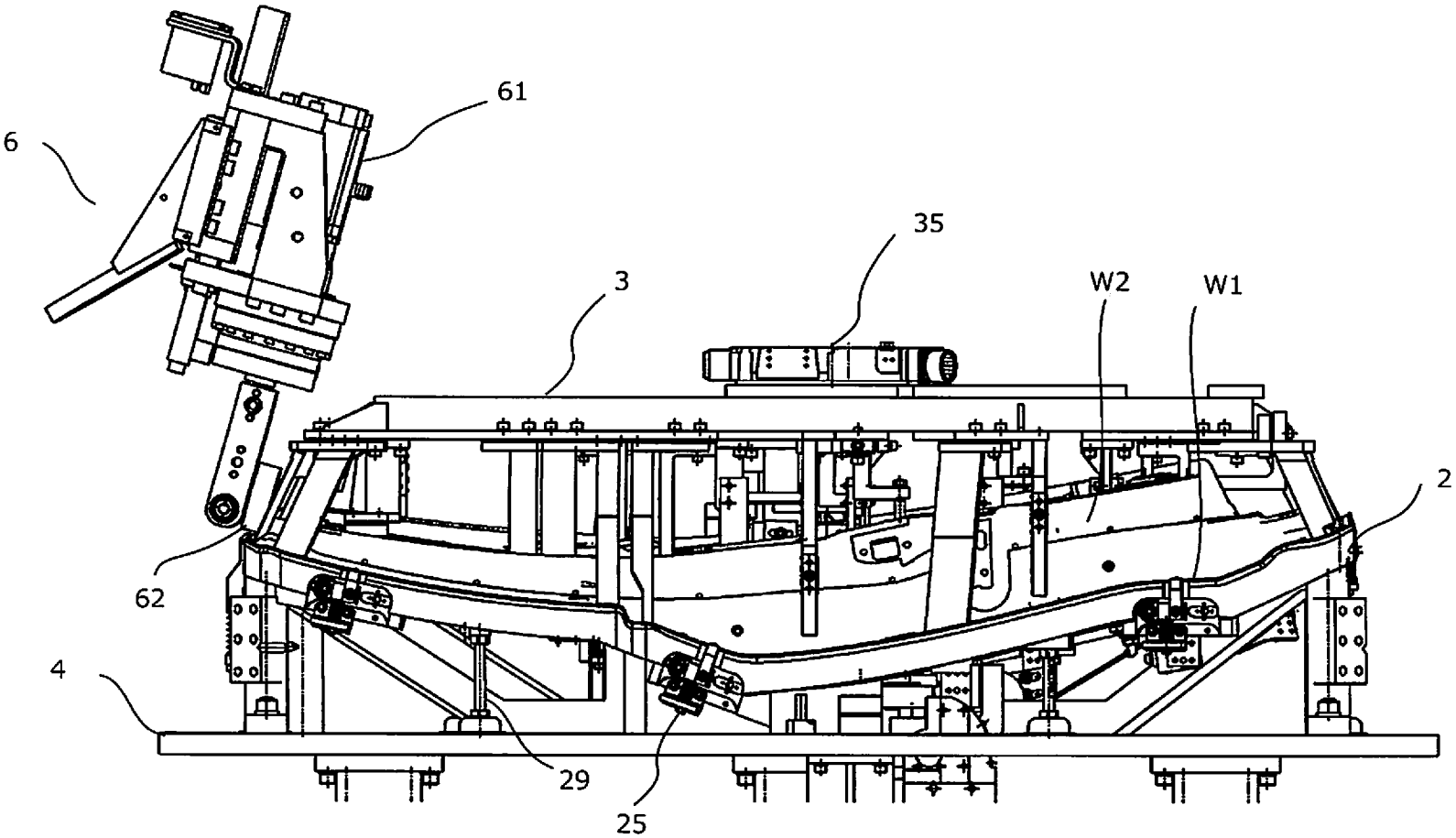
FIG. 9 is a main-part side view corresponding to FIG. 2 and illustrates operation of a hemming device according to the present invention.

As illustrated in FIG. 9, the roller hemming robot 6 carries out preliminary bending and permanent bending of the work W placed on the anvil 2. In preliminary bending, the roller 62 pressed to a portion to be processed of the outer panel W1 bends the portion to be processed at a predetermined angle. In permanent bending, a peripheral portion of the outer panel W1, which has been preliminary bent, is pressed to have a final shape in which the peripheral portion of the outer panel W1 and a peripheral portion of the inner panel W2 overlap. However, depending on a shape of work W, it is difficult to carry out high-quality hemming in two bending processes, i.e., preliminary bending and permanent bending. In that case, it is possible to set, for example, a processing path of three or more processes to secure quality.

After connection between the conveyance robot 5 and the presser material handling portion 3 placed on the anvil 2 is canceled, the conveyance robot 5 moves to a roller-head placement stand 8 without standing by. Then, the conveyance robot 5 holds the roller head 61 and carries out hemming in the same way as the other roller hemming robots 6.

Figure 10:
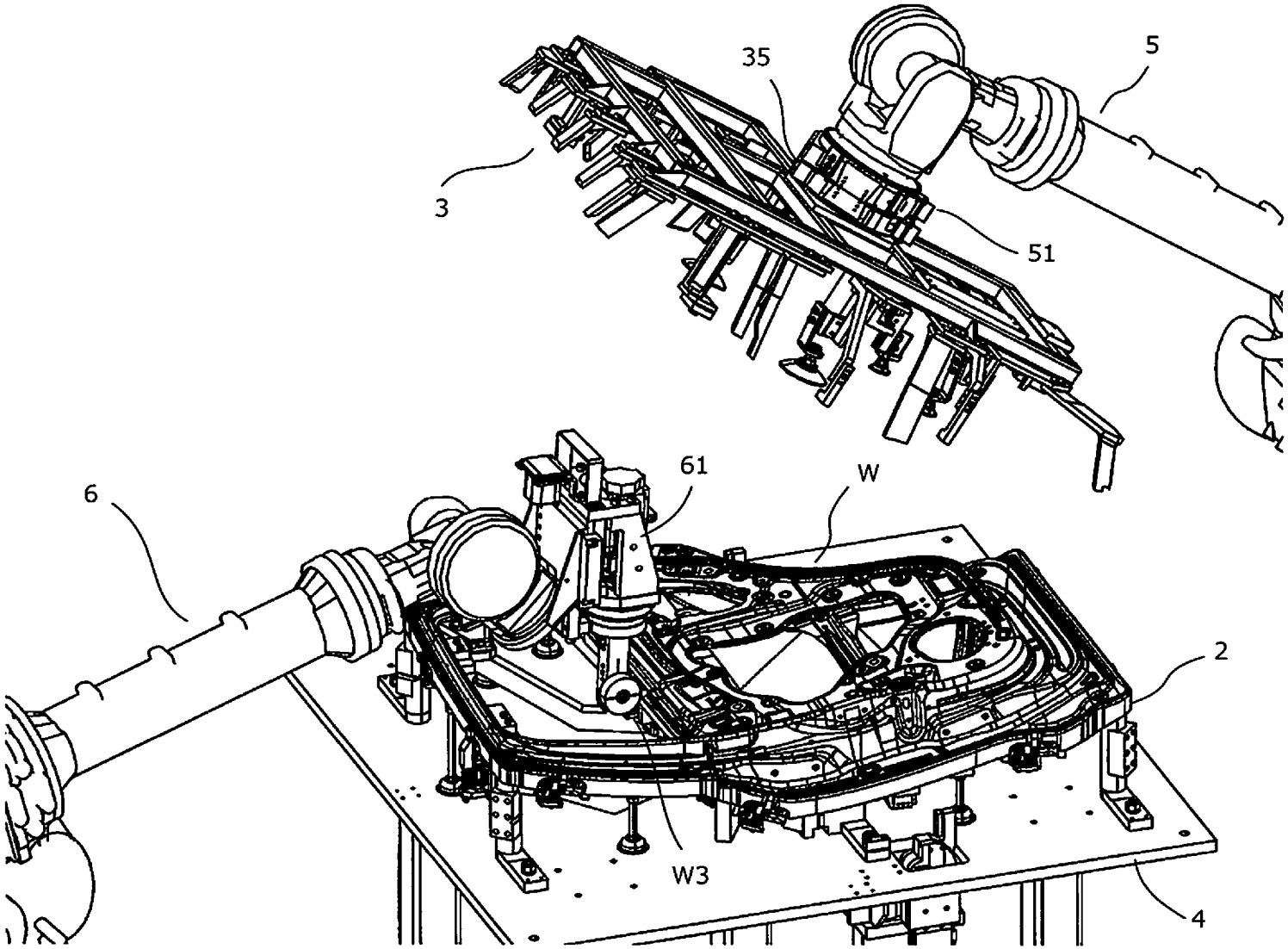
FIG. 10 is a bird's eye view of a state in which an inner circumference of an opening of a work according to the present invention is hemmed, which is seen from a side.
Figure 11:
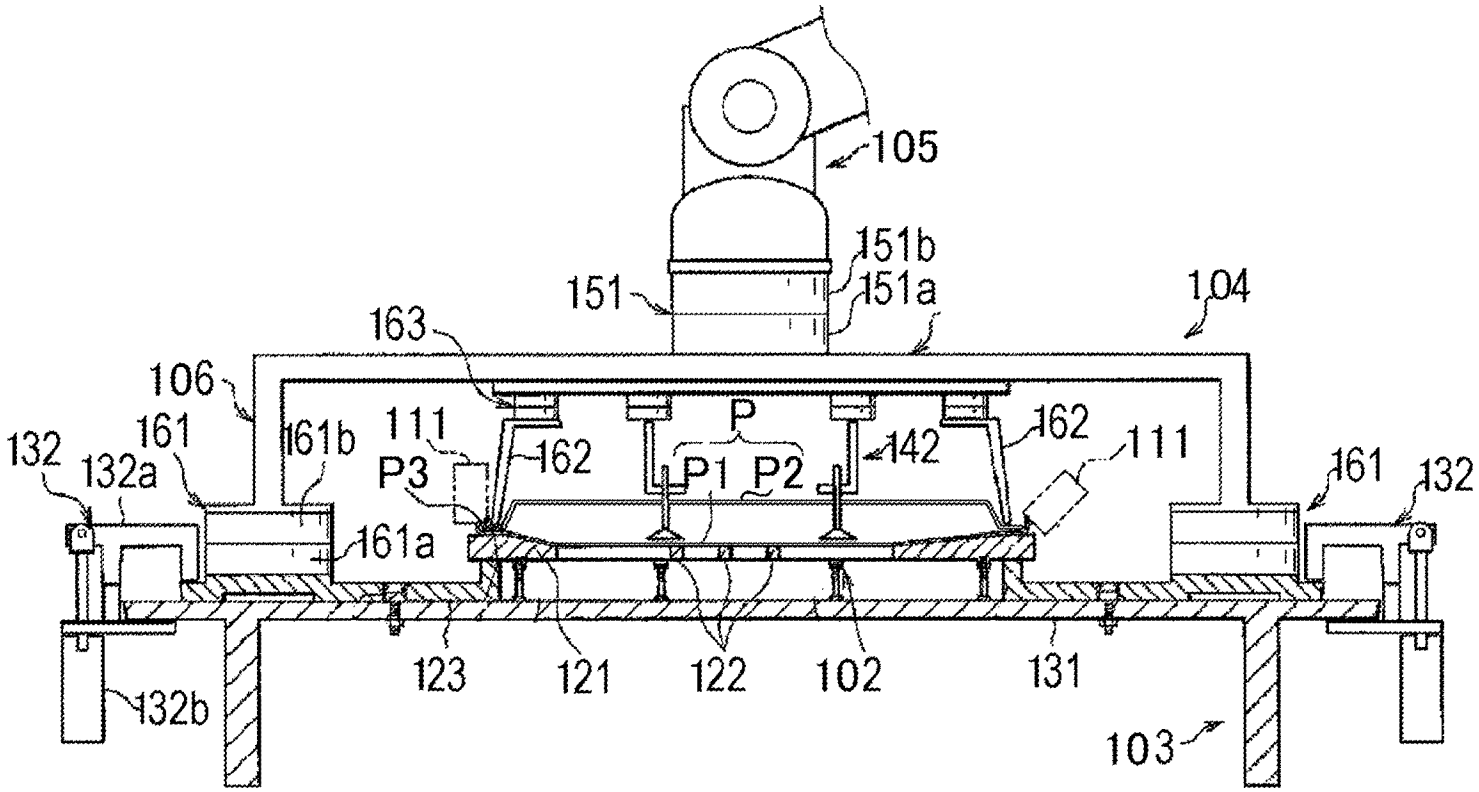
FIG. 11 is a main-part exploded front view of configurations of an anvil and a presser material handling portion in a related art.

When hemming of an outer circumference of the work is terminated, an inner circumference W3 of an opening of the work is hemmed. In this example, the sash portion of the door has a large opening. A portion to be hemmed is also set in an inner circumferential portion of the sash. After processing of the outer circumference of the work is terminated, the conveyance robot 5 places the roller head 61 on the roller-head placement stand 8. Connection between the conveyance robot 5 and the roller head 61 is canceled. Then, the conveyance robot 5 moves to a position above the presser material handling portion 3 and is connected to the presser material handling portion 3. Next, the conveyance robot 5 grips only the presser material handling portion 3 via the ATC device while suction and a grip by the gripping device 33 of the presser material handling portion 3 are being canceled. The conveyance robot 5 evacuates only the presser material handling portion 3 to a position at which the presser material handling portion 3 does not interfere with the roller hemming robot 6 while the work W is being placed on the anvil 2. As illustrated in FIG. 10, the roller hemming robot 6 hems the inner circumference W3 of the opening of the work W placed on the anvil 2 while the conveyance robot 5 is gripping the presser material handling portion 3 and is standing by. At that time, the outer panel W1 and the inner panel W2 are firmly joined because processing of the outer circumference of the work is completed. Therefore, pressing force of the presser material handling portion 3 is unnecessary.

After hemming of the inner circumference W3 of the opening of the work is completed, the conveyance robot 5 places the presser material handling portion 3 on the work W again. The conveyance robot 5 operates the gripping devices 33 of the presser material handling portion 3 and cancels the gripping devices 22 of the anvil 2, thereby sucking and gripping the work W. Then, the conveyance robot 5 conveys the work W to the work placement stand 7 and places the work W on the work placement stand 7, and thus the conveyance robot 5 completes a series of hemming. The inner circumference W3 of the opening of the work does not need to be hemmed by the roller 62. Hemming may be carried out by a hemming punch (not illustrated) provided in the opening 21*h* of the anvil 2.

In the embodiment of the present invention, the conveyance robot 5 evacuates the presser material handling portion 3 from a position above the work W once after hemming of the outer circumference of the work is terminated. With this, the roller hemming robot 6 and the presser material handling portion 3 never interfere with each other at the time of hemming the inner circumference W3 of the opening of the work. This makes it possible to carry out smooth processing. Further, it is possible to remarkably reduce processing time. According to a line configuration in this example which presupposes mass-produced components, setting of the work W to the anvil, roller hemming, and evacuation of the work W to the work placement stand 7 are achieved in cycle time of one minute. Meanwhile, in a line required to cope with high-mix low-volume production, such as a line of repair parts, the steerable roller head is used, and therefore, in a case of a normal door, the whole circumference of the work W can be hemmed by a single roller hemming robot 1. This makes it possible to reduce the number of robots and eliminate a turntable.

Next, operation to carry out replacement operation of the anvil 2 will be described. The conveyance robot 5, which has conveyed the work W to the work placement stand 7 and has terminated the series of hemming, stands by while gripping the presser material handling portion 3 via the ATC device. The other conveyance robot 5, which has operated as a roller hemming robot, places the roller head 61 on the placement stand 8 and cancels connection with the roller head 61. Then, this conveyance robot 5 moves to a position above the anvil supports 4 and grips the anvil 2 via the ATC device. The conveyance robot 5 gripping the anvil 2 conveys the anvil 2 to an anvil placement stand 9*a* illustrated in FIG. 1 and places the anvil 2 on the placement stand 9*a*. The conveyance robot 5, which is standing by while gripping the presser material handling portion 3, conveys the presser material handling portion 3 to the anvil placement stand 9*a*. Then, this conveyance robot 5 places the presser material handling portion 3 on the anvil 2 conveyed to the anvil placement stand 9*a*. Connection between the conveyance robot 5 and the presser material handling portion 3 is canceled. Then, the conveyance robot 5 moves to an anvil placement stand 9*b* on which an anvil 2 to be used in the next process is placed. Thereafter, the conveyance robot 5 grips the anvil 2 via the ATC device. Then, the conveyance robot 5 gripping the anvil 2 conveys the anvil 2 to the anvil supports 4. Thereafter, the conveyance robot 5 places the anvil 2 on the anvil supports 4 so that anvil-side reference pins 27 are inserted into the reference holes. With this, the replacement operation of the anvil 2 is completed. With this, anvil replacement time of 45 seconds is achieved in the present circumstances.

Further, with this, a large-scaled changing device and turntable including dedicated rails and the like, which have been necessary in conventional anvil replacement operation, are unnecessary. Further, the number of switchable models has been conventionally restricted to approximately several models because of, for example, arrangement of the rails. However, according to the present hemming device, it is possible to cope with a larger number of models by arranging, in advance setup, an anvil, a presser hand, and the like necessary for a model in the vicinity of the conveyance robot in advance.

Hereinabove, the embodiment of the present invention has been described. However, the present invention is not limited to the embodiment described above. It is possible to implement appropriate modifications of the embodiment. In this embodiment, a processing device according to the present invention is applied to a hemming device for a door panel. However, the processing device according to the present invention is not limited thereto. The processing device according to the present invention is applicable not only to the hemming device for a door panel but also to a hemming device for a rear door having an opening or the like serving as the work W.

LIST OF REFERENCE SIGNS

1 Hemming device
2 Anvil
3 Presser material handling portion
4 Anvil support
5 Conveyance robot
6 Roller hemming robot
W Work
W1 Outer panel
W2 Inner panel
W3 Inner circumference of opening of work

The invention claimed is:

1. A hemming device, comprising:

an anvil for placing a work including a first plate member and a second plate member;

a presser material handling portion for holding the work;

a conveyance robot for gripping and conveying the presser material handling portion to bring the work to the anvil or bring out the work from the anvil, the conveyance robot including a robot-side ATC device; and a roller hemming robot, wherein:

the robot hems a peripheral portion of the first plate member while pressing a hemming roller of a roller head to a portion to be processed of the work placed on the anvil until the peripheral portion has a final shape in which the peripheral portion and a peripheral portion of the second plate member overlap so that the first plate member and the second plate member are integrated;

the anvil includes an anvil main body portion, a first positioning device provided at a position corresponding to a position of an opening of the work, a first gripping device for sucking and gripping the first plate member, a device-side ATC device to be attached to and detached from the robot-side ATC device, and a guide device for fastening the peripheral portion of at least one of the first plate member or the second plate member, the guide device including:

a main body portion having a first lateral end rotatably supported on the anvil main body portion, and an opposite second lateral end; and an outer guide portion supported on the second lateral end, wherein the outer guide portion is configured, in response to receiving pressure from the hemming roller, to rotate relative to and about the first lateral end of the main body portion of the guide device in a first rotational direction from a first position, in which the outer guide portion projects upwardly from the anvil main body portion, to a second position, in which the outer guide portion does not project upwardly from the anvil main body portion, wherein the outer guide portion is configured to rotate in the first rotational direction whether the hemming roller approaches from the first or second lateral end of the main body portion of the guide device; and the presser material handling portion includes:

a frame portion having a shape corresponding to a shape of the work, a second positioning device arranged at a position corresponding to a position of the first positioning device and engaged with the first positioning device, a second gripping device for sucking and gripping the first plate member through an opening of the second plate member, a presser for pressing the second plate member, the presser being provided at a position at which the presser does not interfere with the final shape, and a device-side ATC device to be attached to and detached from the robot-side ATC device.

2. The hemming device according to claim 1, wherein:

a press by the presser is carried out by using a weight of the presser material handling portion itself or not only a weight of the presser material handling portion itself but also a synergistic action of suction force of the first gripping device and the second gripping device.

3. The hemming device according to claim 2, further comprising:

the roller head including a device-side ATC device detachable from the robot-side ATC device, wherein:

the conveyance robot is configured to operate also as a roller hemming robot by removing the presser material handling portion and then attaching the roller head.

4. The hemming device according to claim 2, wherein:

the roller head is a turnable roller head configured to be attached so that a turnable roller pressing axis has an inclination of 30° to 60° relative to an end surface of a wrist of the robot.

5. The hemming device according to claim 3, wherein:

the anvil is configured to be conveyable by a robot having a conveyance capacity of 270 kg or less; and the conveyance robot replaces the anvil by connecting the robot-side ATC device of the conveyance robot to the device-side ATC device of the anvil.

6. A hemming method for integrally forming a first plate member and a second plate member by bending a peripheral portion of the first plate member having an opening so that the peripheral portion has a final shape in which the peripheral portion and a peripheral portion of the second plate member overlap, the hemming method comprising:

a placement step;

an outer-circumference hemming step;

an inner-circumference hemming step; and bringing-out step, wherein:

the placement step includes:

sucking and gripping the first plate member by using a presser material handling portion through an opening of the second plate member, conveying the presser material handling portion by connecting a robot-side ATC device of the conveyance robot to a device-side ATC device of the presser material handling portion, positioning and placing the presser material handling portion in a posture corresponding to an upper portion of an anvil, the anvil including an anvil main body portion and a guide device for fastening the peripheral portion of at least one of the first plate member or the second plate member, the guide device including:

a main body portion having a first lateral end rotatably supported on the anvil main body portion, and an opposite second lateral end; and an outer guide portion supported on the second lateral end, wherein the outer guide portion is configured, in response to receiving pressure from at least one roller hemming robot, to rotate relative to and about the first lateral end of the main body portion of the guide device in a first rotational direction from a first position, in which the outer guide portion projects upwardly from the anvil main body portion, to a second position, in which the outer guide portion does not project upwardly from the anvil main body portion, wherein the outer guide portion is configured to rotate in the first rotational direction whether the at least one roller hemming robot approaches from the first or second lateral end of the main body portion of the guide device, and carrying out a press and support by using a presser;

the outer-circumference hemming step includes hemming an outer circumference of a work W by using the at least one roller hemming robot;

the inner-circumference hemming step includes:

evacuating the presser material handling portion once from a position above the work by using the conveyance robot, and hemming an inner circumference of an opening of the work W by using the at least one roller hemming robot; and the bringing-out step includes bringing out the hemmed work by using the conveyance robot.

7. The hemming device according to claim 3, wherein:

the roller head is a turnable roller head configured to be attached so that a turnable roller pressing axis has an inclination of 30° to 60° relative to an end surface of a wrist of the robot.

8. The hemming device according to claim 1, wherein the guide device further includes a biasing member disposed below and engaged with the second lateral end of the main body portion of the guide device and configured to resiliently bias the outer guide portion toward the first position.

* * * * *